United States Patent [19]

Feldman et al.

[11] Patent Number: 4,955,276

[45] Date of Patent: Sep. 11, 1990

[54] DANCE PERCUSSION PLATFORM

[75] Inventors: Anita Feldman, 73 Carlton ave., Port Washington, N.Y. 11050; Daniel Schmidt, Berkeley, Calif.

[73] Assignee: Anita Feldman, Port Washington, N.Y.

[21] Appl. No.: 370,602

[22] Filed: Jun. 23, 1989

[51] Int. Cl.[5] ..... G10D 13/08

[52] U.S. Cl. ..... 84/403; 181/141

[58] Field of Search ..... 84/402 R, 403, 410, 84/404, 411 R, 405, 423 R, 423 B, 453, 465, 476; 181/141, 150, 161; 381/152

[56] References Cited

U.S. PATENT DOCUMENTS

| | | | |
|---|---|---|---|
| 3,705,527 | 12/1972 | Burnham | 84/411 R X |
| 4,214,504 | 7/1980 | Rex | 84/411 R |
| 4,777,856 | 10/1988 | Liu et al. | 84/670 |

FOREIGN PATENT DOCUMENTS

| | | | |
|---|---|---|---|
| 7605085 | 5/1976 | Netherlands | 84/402 |
| 804460 | 11/1958 | United Kingdom | 84/402 |

*Primary Examiner*—Brian W. Brown

*Attorney, Agent, or Firm*—Collard, Roe & Galgano

[57] ABSTRACT

A tap dance platform for producing pitched sounds in response to energy imparted onto the surface of the platform having a flat base surface and parallel spaced-apart supports disposed on the flat base. Disposed on each of the spaced-apart supports are a plurality of flat spaced-apart keys which define a sound chamber between the base and the bottom of the keys. The supports are spaced-apart to engage the keys at their vibrational nodes. On the top surface of each of the spaced-apart supports are resilient strips to insulate the keys from the supports and the base to enhance the tonal sound. There are also provided side apertures in both the vertical supports and the side walls of the platform, to allow the sound to come out and to determine the desired sound quality. The ends of the platform are also recesses so that sound can travel out of each end of the platform. Thus, tap dancers can dance on the keys and create unique pitched, percussionlike sounds resembling a marimba.

10 Claims, 2 Drawing Sheets

DANCE PERCUSSION PLATFORM

This invention relates to a dance percussion platform that is capable of making pitched sounds when the surface of the platform is vibrated, such as by dancing on the platform:

More specifically, this invention relates to a dance percussion platform having a plurality of surface boards which are supported at their vibrational nodes so that they can vibrate with specific pitches when they are tapped or struck or stepped on by a dancer's foot, or other object.

DISCUSSION OF THE PRIOR ART

Generally, floors which have been designed for dancing or other foot traffic, are constructed to be vibration proof and not designed to produce their own sounds, or to resonate. There are many different floor designs that are suspended to provide resilience to foot traffic, but include sound deadening devices to eliminate vibration. One sample of a floor construction that is both resilient and sound proof can be found in the Kuhlman, U.S. Pat. No. 2,743,487. A portable dance floor which is modular, is shown in the Cova, U.S. Pat. No. 4,635,425, whereby the modules can be connected together to provide a springy, but quiet, dance floor. Other such floor constructions and systems can be found in U.S. Pat. Nos. 2,862,255; 3,473,281; 3,604,173; 4,443,989, and 4,449,342. All of the above are designed to provide a resilient, sound proof floor or dance surface without tonal sound production.

BRIEF DESCRIPTION OF THE INVENTION

Accoridngly, the present invention provides a dance platform of a modular construction, consisting of a plurality of independently supported boards, which produce pitched sounds in response to foot or tap dance steps on the boards. Each of the platform modules are designed in a shape, such as a square or a hexagon, so that a plurality of them can be put together to form a large dance floor surface, so that dancing performers can produce a variety of pitched sounds as they dance from module to module. The pitched boards or keys of each of the modules are independently supported at their two nodal points of the fundamental vibrational mode (22.5% of the total length from each end). When danced upon, the boards or keys produce a marimba-like sound which can contribute to the percussion portion of any accompanying band or instruments, or can be played as a solo instrument. The particular overtones created by striking the keys are inharmonic in nature with a full harmonic spectrum. This results in a unique sound quality designed to bring out the varied qualities of tap dancing. The pitch and quality of one of each of the keys is defined by undercutting portions of the material from the boards. In the present invention, the modular shaped platform takes the form of a hexagon with seven tonal boards, each of which can be provided with different pitch and tone. The boards can be moved around to facilitate the dancer, or interchanged with spare boards of different pitch or tone, depending upon the music played at the performance. The same module containing the tonal boards can be danced upon by as many as three dancers at the same time to produce the desired marimba-like sounds.

It is therefore an object according to the present invention to provide a modular dance percussion platform capable of producing marimba-like sounds, and having a plurality of differently pitched sound boards.

It is another object, according to the present invention, to provide a dance platform having tuned tonal boards that is simple in design, easy to manufacture, portable and reliable in operation.

Other objects and features of the present invention will become apparent from the following detailed description, considered in connection with the accompanying drawings which disclose the embodiments of the invention. It is to be understood that the drawings are designed for the purpose of illustration only, and not as a definition of the limits of the invention.

DETAIL DESCRIPTION OF THE DRAWINGS

In the drawings, wherein similar referenced characters denote similar elements throughout the several views.

DETAILED DESCRIPTION OF THE INVENTION

Figure 1:
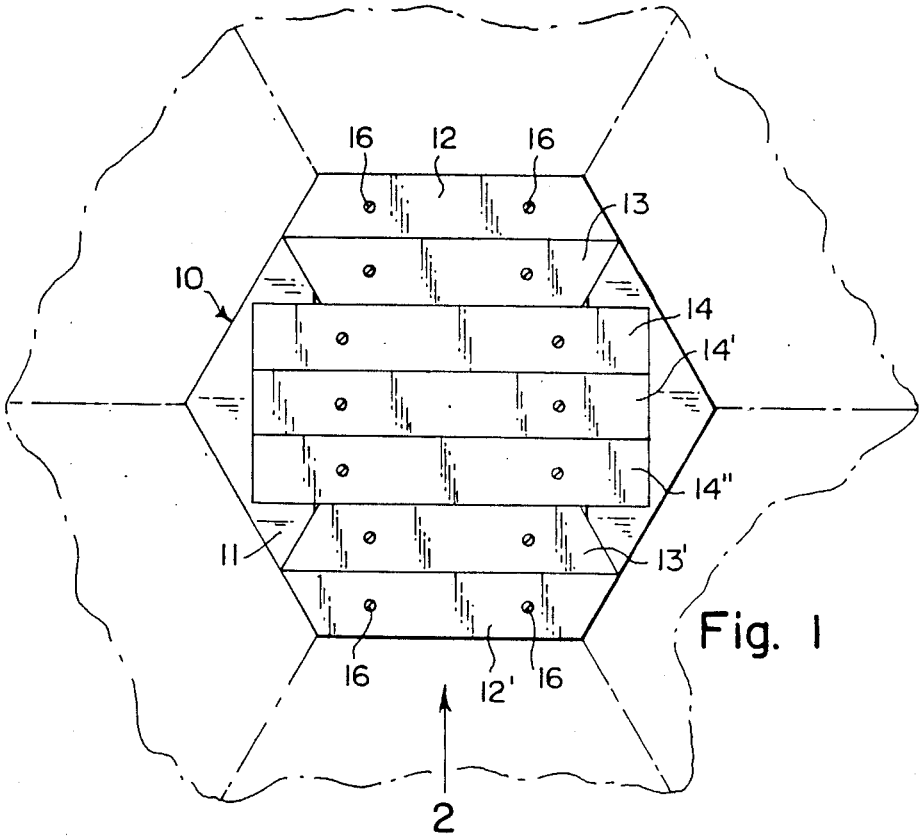
FIG. 1 is a top plan view, showing the modular dance platform according to the invention in the form of a hexagon.

Referring to the drawings, there is shown the tap dance platform generally designated as 10, having a top surface 11, defining an opening into which is disclosed of plurality of tonal boards 12, 12', 13, 13', 14, 14' and 14''. The boards are secured to the instrument by means of a plurality of bolts 16, which pass through the keys and hold the keys down to the supports at the nodal points so that each board is stable with weight up to 200 pounds at any point, yet still vibrates freely. The bolts are preferably tightened only to the extent necessary for reasonable stability of the key.

Figure 2:
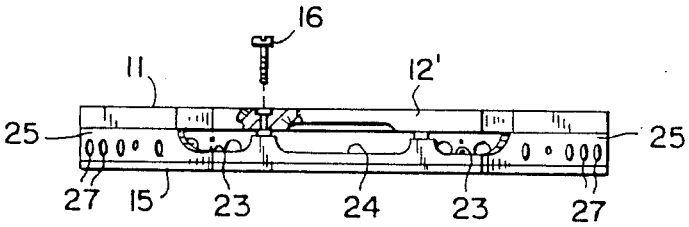
FIG. 2 is an end view, taken along the bottom edge of FIG. 1, as shown by the arrow 2.
Figure 3:
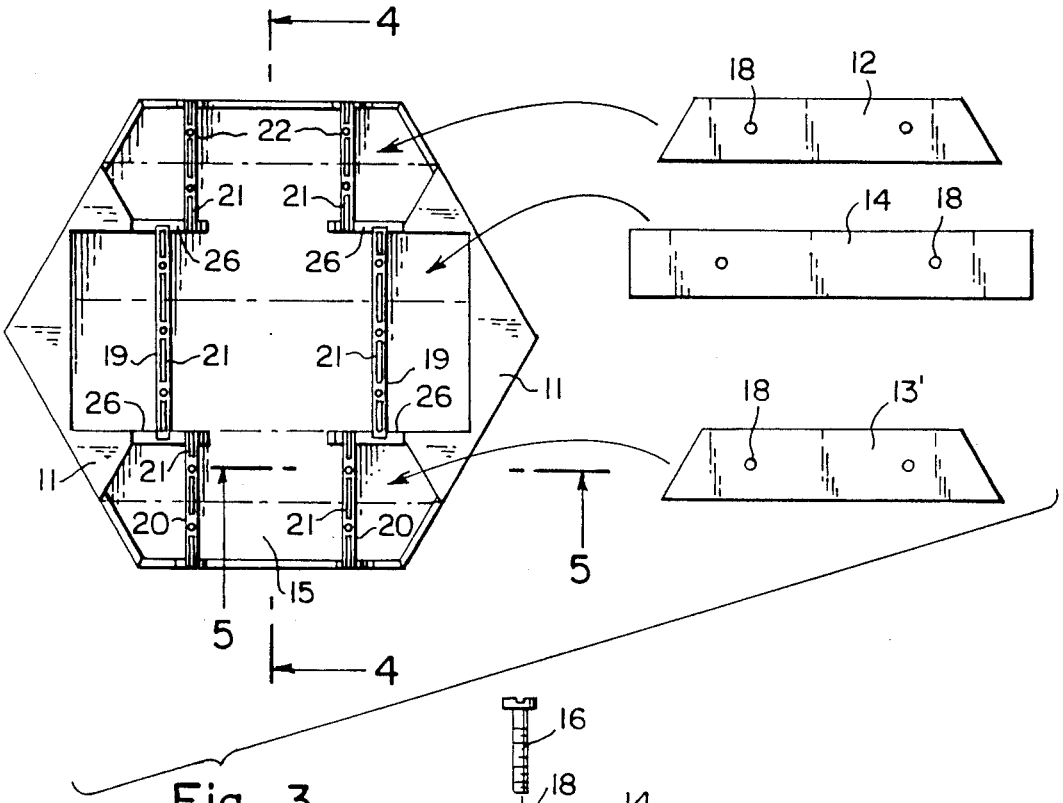
FIG. 3 is a top plan view with the tuned tonal boards removed from the instrument.
Figure 4:
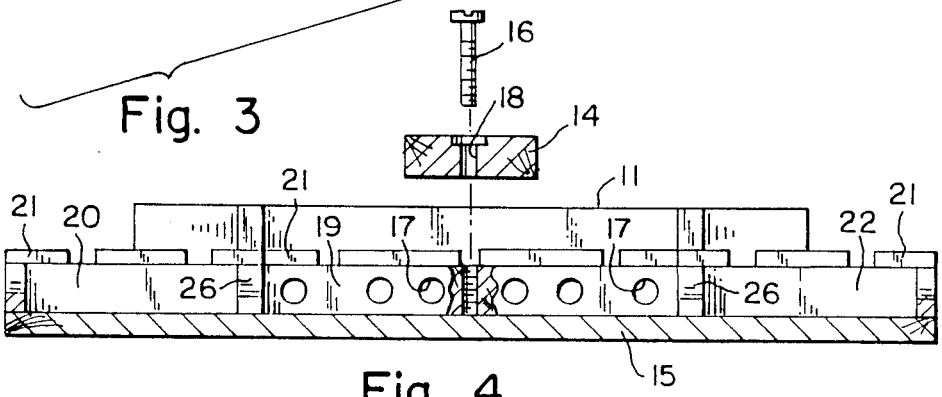
FIG. 4 is a cross-sectional view taken through section 4—4 of FIG. 3; and, FIG. 5 is a cross-sectional view taken through section 5—5 of FIG. 3.
Figure 5:
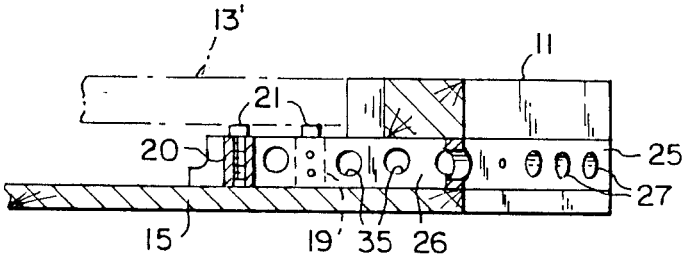

As shown in detail in FIGS. 3, 4, and 5, the particular embodiment shown is in the shape of a hexagon to accommodate seven pitched boards. The platform is provided in a flat base 15, which is designed to sit flat on a dance floor or stage. A plurality of spaced apart parallel supports 19, 20, and 22, are mounted on base 15. A resilietn insulation strip material, such as a closed cell rubber foam 21, is disposed on the top surface of each of supports 19, 20, and 22, between each of the screw holes, to avoid transferring to "clunk" sound coming from the weight of the dancers hitting the platform surface. Spaced apart parallel supports 19, 20, and 22, and their accompanying resilient strips 21, are positioned to support the pitched boards 12–14 at the nodes of the boards, so that a maximum vibration of the boards can be obtained when they are struck by an object. Moreover, parallel, spaced-apart supports 19 are provided with a plurality of holes 17 along their flat surface, so that the sound will travel through the holes to other parts of the platform, and so that the keys have the desired sound qualities. Likewise, transverse cross members 26, which interconnect supports 22 to supports 19, and supports 20 to supports 19, also are provided with holes 35, as shown in detail in FIG. 5. Around the side walls 25 of the instrument, which are located between top deck 11 and bottom surface 15, are holes 27 which also allow the sound to come out of the modular platform and contribute to detemining the sound quality. At each end of the instrument, where tonal boards 12 and 12' are mounted, are open walls which have cut away slots 23 and 24, as shown in detail in FIG. 2, to allow the sound to come out from the ends of the platform.

In the actual construction of an embodiment of the invention, the boards were selected from stock lumber, such as 2×6's or 2×8's of spruce wood and form the keys of the instrument. The keys can support weights up to 200 pounds, when any part of the key is jumped upon. Spruce was selected since it is a resonant wood, and was finished with a Watco oil in order to toughen its surface, seal it from moisture, and provide a non-slippery surface. Each of the spruce keys are supported on the strips of insulation rubber 21, which are approximately ⅜ of an inch wide and secured to the spaced apart supports 19, 20, and 22. Bolts 16, which hold the spruce keys in place, on to supports 19, 20, and 22, were selected from hardened steel hex head bolts. The bolts were hardened so they would not wear out or bend with pressure, or allow the spruce keys to tip when weight was placed on any part of the keys. Each of the bolt holes 18, provided at the nodal points of the spruce keys, has a recess so that the hex heads of bolts 16 will be counter bored below the board surface, and will not interfere with the performance of the tap dancing. Supports 19, 20, and 22 are constructed of a thin wood framework and are bolted to the flat base 15.

The inner framing of the platform is preferably constructed of maple for strength and bottom 15 was constructed of a Finnish birch plywood.

In tuning the keys, it was found that special consideration had to be given to the fact that it was going to be struck by a metal tap in many ways. Tap dancers strive to produce a variety of different types of sounds depending upon how the shoes hit the floor. Examples of the types of strikes include (a) an open stroke coming from any direction with the toe, (b) a closed stroke with the toe with weight, (c) a heel drop closed stroke, and, (d) a heel scuff open stroke. It is one goal of the invention that the dancer be able to make this variety of sounds on the keys, all of them being pitched. To this end, the keys are tuned to give inharmonic overtones with a board harmonic spectrum as each key is struck by a shoe. This range of overtones of each of the seven keys of the platform is partially achieved by undercutting the keys directly inside of the nodal points, removing material from the center portion of the keys, or by thickening the center portion of the keys. The radius of the change of the thickness of wood directly inside of the nodal points effects the harmonic spectrum of each key.

Also effecting th overtones is the design of the sound chamber between the keys and the base. Since the platform has to be constructed to be as low to the floor as possible for the safety of the dancers, in one embodiment 5 inches, the low internal space below each of the spruce keys, particularly the encompassed center three keys, causes lower overtones to predominate. In the design of the platform, center supports 19 are provided with venting or holes 17 to magnify the higher overtones, and no holes are provided through supports 20 or 22, which hold the shorter end keys 12, 13, 12', and 13', in order to magnify the lower overtones. This gives the end keys a similar tonal quality to the larger inside keys.

Subtle pitch adjustments are made by removing small amounts of wood from the bottom of the ends of the keys or directly in the center. The three center keys, 14, 14', and 14'', are longer than the end keys, and provide lower or identical tones. In one embodiment, the center keys were tuned to middle C, and E and F above middle C. The shorter end keys, 12, 12', 13, and 13', can be tuned to identical and higher notes such as F above middle C, G above middle C, A above middle C and C above middle C.

The platform of the invention is preferably provided with additional keys of different notes, so that the performer can easily remove the keys by removing bolts 16, and place keys of different pitches on to the support surfaces to create varying types of music. Likewise, the keys can be switched around to different positions to help the dancer bring out different musical qualities without having to take large steps across the platform. For example, spruce keys 12, 13, 12', and 13', are all of the same size and have the same hole spacings, so that they can be interchanged in any one of the four positions located at each end of the platform.

So that the keys can be switched around, it is necessary that the keys have consistent quality of sound no matter where they are located. The side walls of the platform 25, the key supports 19 and the transverse cross members are perforated with holes, so that no key couples with the resonance of the space in any location, allowing the keys to be switched.

When each of the spruce keys is set into its support and bolted down, there is a small air gap separating each key from one another, and top deck 11 of the platform, so that there is no sound vibration interference between each key and the platform. The platform is built to be stable, even if two or three dancers are performing on one side at the same time. It was found that the platform produces its best sound with a padding, such as carpet or rubber, placed underneath its base 15.

It is obvious that the platform of the present invention can be designed in any other shape such as an octagon or a square, to form part of a modular pattern and be fitted together with other similar platforms to form a large tap dancing stage floor. The platform can also be provided with different numbers of keys instead of the seven keys which are shown.

While only a single embodiment of the present invention has been shown as described, it will be obvious that many changes and modifications may be made thereunto without departing from the spirit and scope of invention.

What is claimed is:

1. A tap dance platform, to be placed on the ground or a floor surface, for producing pitched sounds in response to energy imparted onto a surface of the platform comprising:

a planar flat base surface supported by the ground or floor surface;

parallel, spaced-apart supports mounted on said base surface and having resilient insulating strips disposed on their top surface;

sidewalls joined to the periphery of said base surface to form a partially closed container thereof, said sidewalls including apertures therethrough for permitting sound to escape from within the platform;

a plurality of flat, elongated spaced apart keys demountably secured to the strips of said supports, which contact the entire width of each key for the purpose of stability, to define a sound chamber between the base and a bottom of the keys, said supports being spaced aparat to engage each key at its two nodal points of a fundamental vibrational mode; and a top surface mounted on said side walls and partially surrounding the ends of said keys, said top surface being level with a surface of said keys, said keys, said top and sidewalls, and said flat base surface defining a resonant sound chamber within and forming a substantially flat dance platform suitable for precise placement of feet without limitation over entire surface of instrument;

said keys being closely spaced apart to define a small air gap between the individual keys, themselves, and the top surface of the platform, said air gap being just sufficiently wide enough so that the keys are free to vibrate independent of one another, and independent of the top surface.

2. The platform as recited in claim 1, wherein said supports include side apertures for permitting the sound to exit from the sound chamber defined between the base and the bottom of the keys, for determining the desired sound quality, and so that no key couples with the resonance of the space in any location, allowing the keys to be switched.

3. The platform as recited in claim 1, wherein the walls at the ends of the platform are slotted open to allow the sound from the resonant chamber to escape.

4. The platform as recited in claim 3, wherein the base is in the form of a hexagon, having three center keys of different pitches and are of the same length, enabling the keys to be switched, and four end keys shorter than the center keys.

5. The platform as recited in claim 4, wherein said four end keys are of different pitches and are of the same length, enabling the keys to be switched.

6. The platform as recited in claim 5, wherein said keys are demountably bolted with recessed bolts to said parallel spaced-apart supports.

7. The platform as recited in claim 1, wherein said resilient strips are constructed or rubber and disposed across the entire width of each key providing stability.

8. The platform as recited in claim 1, wherein each of said plurality of spaced-apart keys are constructed of spruce boards.

9. The platform as recited in claim 8, wherein each key is tuned by removing wood from the ends or center of the keys.

10. The platform as recited in claim 1, wherein the base and top surface is constructed as a hexagon.

* * * * *